US010524599B1

(12) United States Patent
O'Neill

(10) Patent No.: US 10,524,599 B1
(45) Date of Patent: Jan. 7, 2020

(54) FLEXIBLE STRAW AND SYSTEM AND METHOD OF MANUFACTURING THE SAME

(71) Applicant: Hoffmaster Group, Inc., Oshkosh, WI (US)

(72) Inventor: John P. O'Neill, Fort Wayne, IN (US)

(73) Assignee: Hoffmaster Group, Inc., Oshkosh, WI (US)

( * ) Notice: Subject to any disclaimer, the term of this patent is extended or adjusted under 35 U.S.C. 154(b) by 0 days.

(21) Appl. No.: 16/378,675

(22) Filed: Apr. 9, 2019

Related U.S. Application Data

(63) Continuation of application No. 16/173,809, filed on Oct. 29, 2018, now Pat. No. 10,299,613, which is a continuation of application No. 14/706,632, filed on May 7, 2015, now Pat. No. 10,130,202.

(60) Provisional application No. 61/990,032, filed on May 7, 2014.

(51) Int. Cl.
*A47G 21/18* (2006.01)
*B31F 1/20* (2006.01)

(52) U.S. Cl.
CPC ..... *A47G 21/186* (2013.01); *A47G 21/18* (2013.01); *B31F 1/205* (2013.01)

(58) Field of Classification Search
CPC ..... A47G 21/18; A47G 21/186; B31F 1/205
See application file for complete search history.

(56) References Cited

U.S. PATENT DOCUMENTS 589,694 A 9/1897 Capewell
700,662 A 5/1902 Koffler
1,210,895 A 1/1917 Brinkman
1,843,395 A 2/1932 Lauterback
1,860,989 A 5/1932 Brinkman
1,954,881 A 4/1934 List
2,002,896 A 5/1935 Kopetz
2,093,155 A 9/1937 Muller
2,094,268 A * 9/1937 Friedman ..... A47G 21/186 215/388
2,390,533 A 12/1945 Hill
2,550,797 A 5/1951 Friedman
(Continued)

OTHER PUBLICATIONS

"Eco-Flex: Innovation by Design". Found online Mar. 11, 2016 at aardvarkstraws.com. Page dated Apr. 12, 2015 Retrieved from http://web.archive.org/web/2015041208505 8/http://www.aardvarkstraws.com/eco-flex/.
(Continued)

*Primary Examiner* — Ryan A Reis
(74) *Attorney, Agent, or Firm* — Nicholas A. Kees; Godfrey & Kahn, S.C.

(57) ABSTRACT

A corrugating machine for forming a flexible paper drinking straw by forming annular corrugations in a tube, including a plurality of corrugating elements and means for moving the tube against the corrugating elements. Each of the corrugating elements is spaced apart from each other in both a lateral direction and a forward direction. The corrugating machine includes an assembly spool and a drum mounted to a side of the assembly spool for rotation about a common axis. A mandrel is mounted to the drum for reciprocation into and out of the spool assembly, to carry the tube against the corrugating elements mounted in an arc defined about the common axis.

22 Claims, 13 Drawing Sheets

(56) References Cited

U.S. PATENT DOCUMENTS

| | | | | | |
|---|---|---|---|---|---|
| 2,631,645 | A | * | 3/1953 | Friedman | B21D 15/06 138/122 |
| 2,985,077 | A | | 5/1961 | Strahammer et al. | |
| 3,012,604 | A | * | 12/1961 | Zieg | B21C 37/205 264/286 |
| 3,025,004 | A | | 3/1962 | Levi | |
| 3,122,977 | A | | 3/1964 | Graham | |
| 3,242,828 | A | | 3/1966 | Larkin | |
| 3,346,187 | A | | 10/1967 | Mueller | |
| D209,382 | S | | 11/1967 | Nardone | |
| D211,226 | S | | 5/1968 | Nardone | |
| 3,409,224 | A | | 11/1968 | Harp | |
| 3,438,578 | A | | 4/1969 | Peterson et al. | |
| 3,641,884 | A | * | 2/1972 | Jivoin | B29C 53/30 264/286 |
| 4,216,801 | A | | 8/1980 | Aykanian | |
| D275,542 | S | | 9/1984 | Hacke | |
| 4,613,474 | A | * | 9/1986 | Donati | B29C 53/30 198/803.12 |
| 5,158,532 | A | | 10/1992 | Peng | |
| D561,282 | S | | 2/2008 | Rollinson | |
| D699,997 | S | | 2/2014 | van der Lande | |
| D757,476 | S | | 5/2016 | O'Neill | |
| 9,974,403 | B1 | | 5/2018 | O'Neill | |
| 2003/0134254 | A1 | | 7/2003 | Filho | |
| 2005/0087619 | A1 | | 4/2005 | Nasr | |
| 2008/0023567 | A1 | | 1/2008 | Byerly | |
| 2009/0188927 | A1 | | 7/2009 | Allen | |
| 2009/0283608 | A1 | | 11/2009 | Crawley | |
| 2015/0190004 | A1 | | 7/2015 | Chang | |

OTHER PUBLICATIONS

"Norpro 428 50-Pack Flexible Straws, Multicolored". Found online Mar. 11, 2016 at amazon.com. Page dated Sep. 7, 2012. Retrieved from http://www.amazon.com/Norpro-428-50-Pack-Flexible-Multicolored/dp/BOOOSSVBXE.

"Prirnastraw-Primaplastindonesia". Found online Mar. 11, 2016 at primastraw com. Page dated c. 2011. Retrieved from http://www. primastraw .com/products/ flexible-straw/.

* cited by examiner

FLEXIBLE STRAW AND SYSTEM AND METHOD OF MANUFACTURING THE SAME

CROSS-REFERENCE TO RELATED APPLICATIONS

This application is based on and claims the benefit of U.S. Provisional Application No. 61/990,032, filed on May 7, 2014, and is a continuation of U.S. patent application Ser. No. 16/173,809, filed on Oct. 29, 2018, which is a continuation of U.S. patent application Ser. No. 14/706,632, filed on May 7, 2015, now U.S. Pat. No. 10,130,202, all of which are incorporated herein by reference in their entirety for all purposes.

BACKGROUND OF THE INVENTION

The present invention relates generally to consumer products, and more particularly to paper consumer products and machines for forming them.

Drinking straws are a very old art. A straw is a simple tool that exploits a change in air pressure to cause a fluid to rise above a settled level in a receptacle such as a cup. The first mass-produced drinking straws were formed from paper. At the time, available technology allowed paper straws to take on a limited number of shapes to produce only a limited variety of paper straws. Further, paper straws were more susceptible to sogginess, degradation, cavitation, and crumpling or collapsing. Additionally, paper straws could not bend repeatedly without being destroyed. Plastic drinking straws soon replaced paper straws and made a huge variety of shapes to be manufactured. Plastic drinking straws had numerous advantages over paper straws beyond varied shapes. Plastic drinking straws could withstand exposure to liquid far longer than paper straws could. Plastic straws could handle hot liquids much better. Plastic straws were fairly rigid and resilient, even after accidental bending. Plastic straws could be constructed with very thin sidewalls and thus use very small amounts of material at low cost. Plastic straws could be produced on very simple machines capable of forming the straws very quickly. Plastic straws were extremely light in weight. For many of these reasons, plastic straws quickly rendered paper straws virtually obsolete for all but a few purposes.

Paper straws, nonetheless, have retained some relevancy in the novelty, party, and specialty markets. Paper drinking straws are generally highly engineered and cost four to five times more than plastic straws. This increased cost is usually justified by the nature of the novelty, party, or specialty purpose for which the straws are being purchased. However, the old problems of paper straws still persist: paper straws frequently will collapse with use or will collapse if bent too far or too frequently. Paper straws can cavitate if they become soggy or crushed. The paper used to form the straws can be difficult to work on a mass-production machine, and construction of paper straws can thus be slow. An improved paper drinking straw, and method for forming one, is needed.

SUMMARY OF THE INVENTION

A machine for forming a flexible paper drinking straw by forming annular corrugations in a tube includes a plurality of corrugating elements and means for moving the tube against the corrugating elements. Each of the corrugating elements is spaced apart from each other in both a lateral direction and a forward direction. The corrugating machine includes an assembly spool and a drum mounted to a side of the assembly spool for rotation about a common axis. A mandrel is mounted to the drum for reciprocation into and out of the spool assembly, to carry the tube against the corrugating elements mounted in an arc defined about the common axis.

BRIEF DESCRIPTION OF THE DRAWINGS

Referring to the drawings.

DETAILED DESCRIPTION

Figure 1:
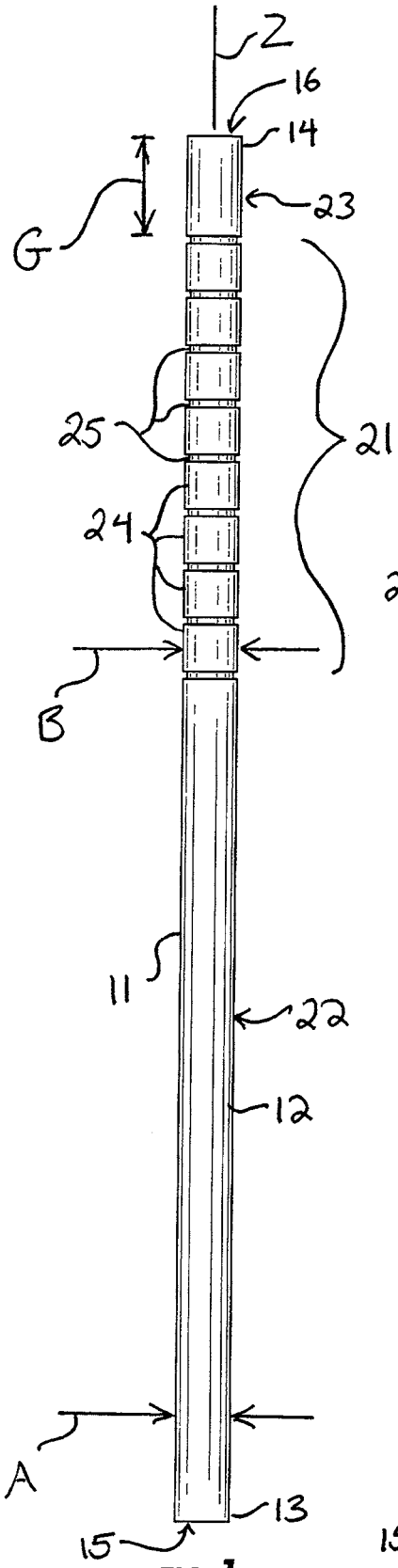
FIG. 1 is a side elevation view of a straw constructed and arranged according to the principle of the invention.

Reference now is made to the drawings, in which the same reference characters are used throughout the different figures to designate the same elements. FIGS. 1-5 illustrate an embodiment of a drinking straw 10 preferably constructed from a paper material and arranged according to the description below. The straw 10 has an elongate body 11 formed from a generally cylindrical sidewall 12 extending between an open bottom 13 and an opposed open top 14. While the bottom 13 and the top 14 need not necessarily function as a bottom and top for the straw 10, the straw 10 is used in a similar fashion to a conventional plastic drinking straw for which the ends are typically and similarly defined and used. As such, the terms "bottom" 13 and "top" 14 will be used herein without limiting the structure or use of the straw 10. The sidewall 12 of the straw 10 has an outer diameter A which is generally constant between the bottom 13 and the top 14, except as will be specifically described. Circular openings 15 and 16 are defined at both the bottom 13 and the top 14 by the cylindrical sidewall 12, and an interior 20 (shown only in FIGS. 4 and 5) of the straw 10 is bound and defined by the sidewall 12, the bottom 13, and the top 14. The interior 20 is generally cylindrical in shape and is in fluid communication with both of the openings 15 and 16. As with a conventional plastic drinking straw, a user draws liquid up the straw 10 from the opening 15 at the bottom 13, through the interior 20 to the opening 16 at the top 14, and then out through the opening 16 into the user's mouth for consumption.

Figure 2:
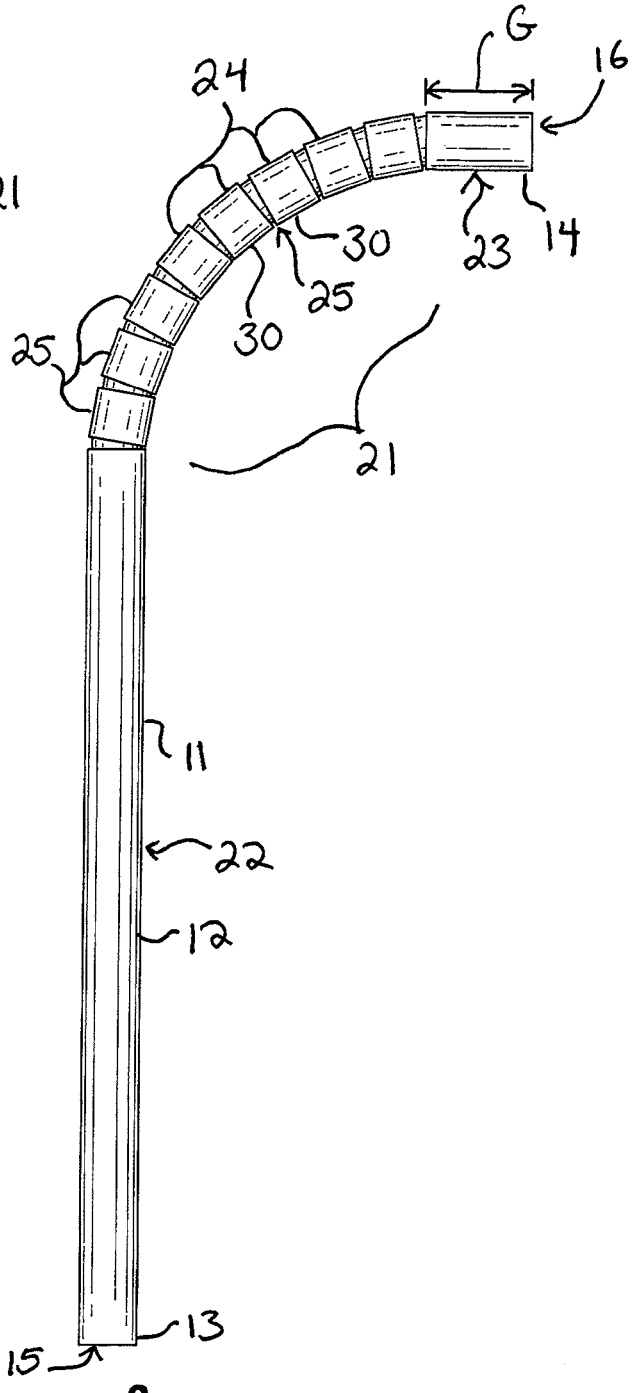
FIG. 2 is a side elevation view of the straw of FIG. 1 shown in a bent configuration.
Figure 3:
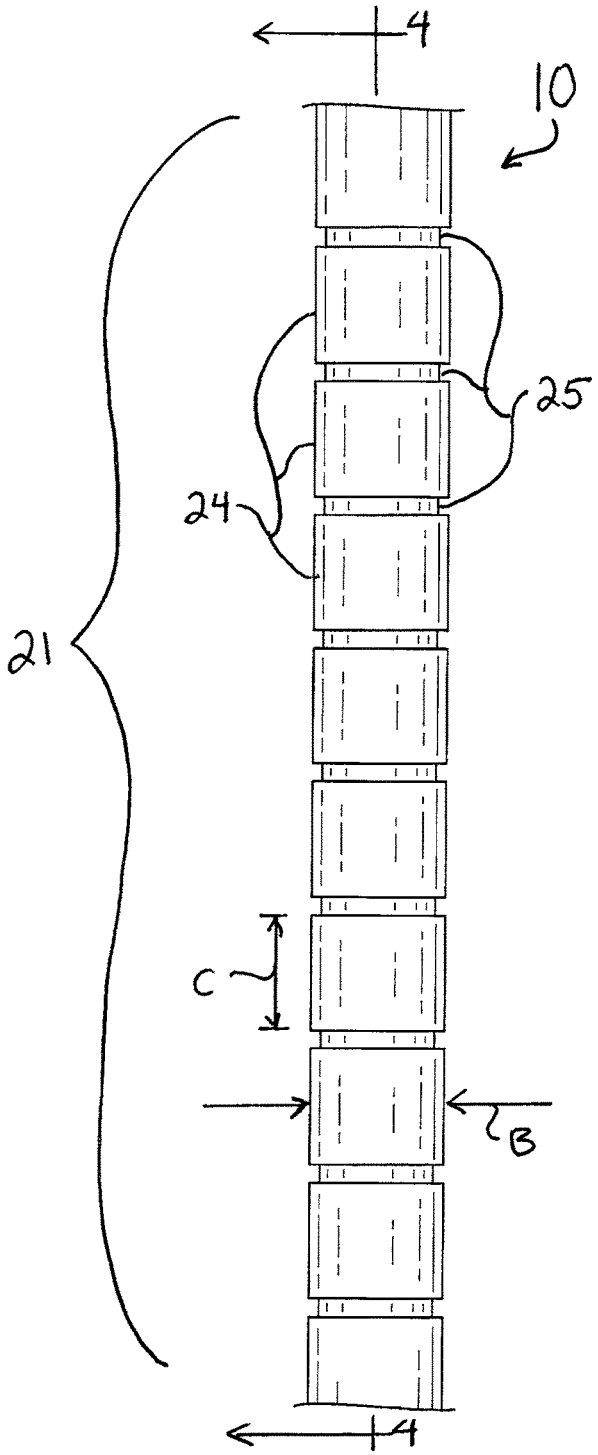
FIG. 3 is an enlarged view of a flexible region of the straw of FIG. 1.
Figure 4:
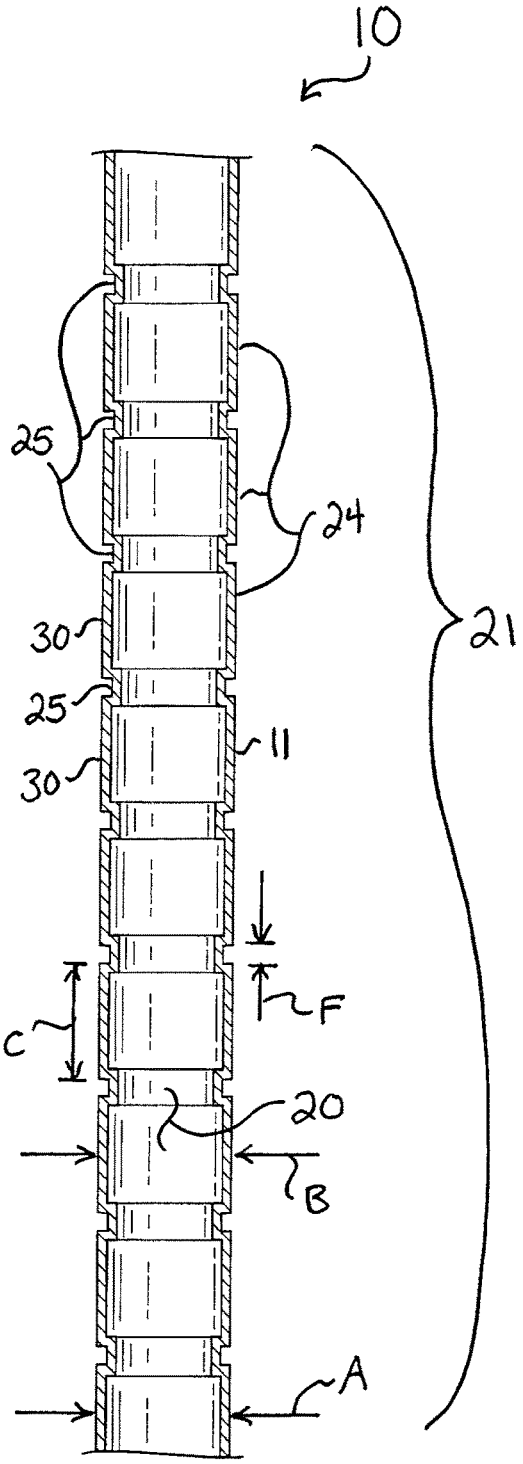
FIG. 4 is an enlarged section view bisecting the flexible region of the straw of FIG. 1 along the line 4-4 of FIG. 3.

The straw 10 is a flexible, or "bendy," straw constructed of a paper material. When initially manufactured and shipped, the straw 10 typically has a straight configuration, as shown in FIGS. 1, 3, and 4, in which the straw 10 has rotational symmetry with respect to a longitudinal axis Z (shown only in FIG. 1) extending through the interior 20 of the straw 10 between the bottom 13 and the top 14. When used by a user, the user may prefer to leave the straw 10 in its straight configuration or may prefer to bend the straw 10, similarly to a bent configuration shown in FIGS. 2 and 5. The straw 10 is constructed to endure repeated bending and flexing.

The sidewall 12 of the straw 10 is preferably constructed from multiple helically-wound plies of thin paper treated to be substantially fluid impervious. The multiple-ply and helical construction provides the sidewall 12 with rigidity to maintain the elongate and cylindrical form of the straw 10, and to prevent bending in the sidewall 12. The elongate plies are helically-wound at approximately a forty-seven degree (47°) angle to the longitudinal axis Z of the straw 10 to form the sidewall 12. Three of the inner plies are approximately 0.580 inches (approximately 1.47 centimeters) in width and 0.004 inches (approximately 0.010 centimeters) in thickness. When wound, the plies are not overlapped, and at all points of the straw 10, the sidewall 12 is four plies thick. The outermost ply is thinner than the inner three plies, but is wider at approximately 0.650 inches (approximately 1.65 centimeters) in width. Additionally, the outermost ply is overlapped and formed of a combination of materials providing it with a fluid impervious material characteristic, such as the combination of a thin wax film on the paper ply. With three inner plies of substantially fluid impervious material and a wide outer layer formed of a fluid impervious ply, the straw 10 is fluid impervious and resistant to sogginess and degradation from prolonged exposure to fluids.

A flexible region 21 is formed in the straw 10 to allow the straw 10 to bend and flex. The flexible region 21 is formed in the sidewall 12 of the straw 10 just below the top 14. The flexible region 21 extends from just below the top 14 to a location generally intermediate between the bottom 13 and the top 14. The flexible region 21 is disposed between and thus defines a base 22 and an opposed tip 23. The base 22 extends between the bottom 13 and the flexible region 21, and the tip 23 extends from the top 14 to the flexible region 21. The straw 10 is rigid and inflexible along both of the base 22 and the tip 23, and the flexible region 21 is the only portion of the straw 10 which is available for bending.

With reference now especially to FIGS. 3 and 4, the flexible region 21 is a bend structure, and is formed from a plurality of segmented sidewall sections 24 defined between and separated from each other by inward, annular corrugations 25. There are preferably eight segmented sidewall sections 24 in the straw 10 between nine annular corrugations 25. The segmented sidewall sections 24 each have outer diameters B transverse to the longitudinal axis Z and coextensive to the outer diameter A of the straw 10, and each of the segmented sidewall sections 24 also has a height C parallel to and along the longitudinal axis Z of the straw 10. The height C is equal to the diameter B of the segmented sidewall section 24, such that each segmented sidewall section 24 is somewhat squat, because each is as tall as it is wide. Further, the height C is always normal to the diameter B, so that each segmented sidewall section always defines a right cylinder. The squat nature of each segmented sidewall section 24, coupled with its right cylindrical shape and construction from multiple plies of paper, help provide the segmented sidewall section 24 with structural integrity and rigidity across the height C of the segmented sidewall section 24 and which resists crushing, collapsing, or bending across the diameter B.

Figure 5:
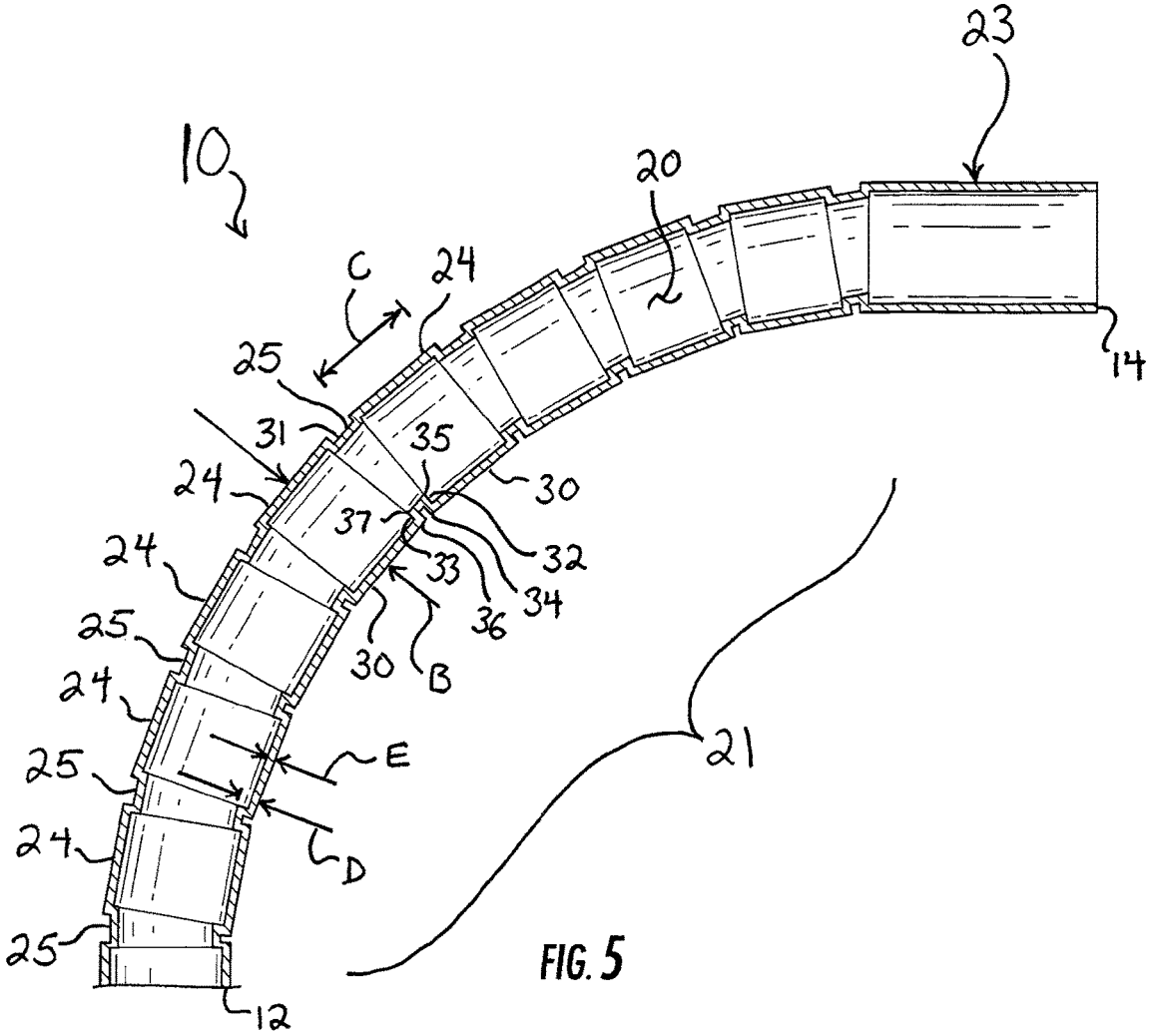
FIG. 5 is an enlarged section view bisecting the flexible region of the straw of FIG. 1 along the line 4-4 of FIG. 3, with the straw shown in a bent configuration.

Each segmented sidewall section 24 is bound by one of the annular corrugations 25 above the segmented sidewall section 24 and another of the annular corrugations 25 below the segmented sidewall section 24. All of the annular corrugations 25 are capable of collapsing to allow the flexible region 21 to flex and bend so as to allow the straw 10 to bend only at the flexible region 21. Referring to FIG. 2 and FIG. 5, the annular corrugation 25 in the middle of the flexible region 21 will be described in an exemplary fashion. It will be understood that the ensuing description of the annular corrugation 25 in the middle of the flexible region 21 applies equally to the other annular corrugations 25, with appropriate and necessary correction for location. Other than location, all of the annular corrugations 25 function and are structured identically to the annular corrugation 25 in the middle of the flexible region 21.

The annular corrugation 25 is a corrugation in the sidewall 12: it is a circular furrow or inward fold in the sidewall 12 defined by particular structure. The segmented sidewall sections 24 above and below the annular corrugation 25 each include a flat, smooth, cylindrical outer face 30 which is parallel to the longitudinal axis Z. The annular corrugation 25 has a flat, smooth, cylindrical span or outer face 31 set in radially from the outer faces 30 of the segmented sidewall sections 24. The outer face 31 of the annular corrugation 25 is connected to each of the outer faces 30 of the segmented sidewall sections 24 with upper and lower annuli 32 and 33. The upper annulus 32 is a bend between the outer faces 30 and 31 and is integral to each. The upper annulus 32 defines an upper outer shoulder 34, with the outer face 30 of the segmented sidewall section 24 above the annular corrugation 25, and an upper inner shoulder 35, with the outer face 31 of the annular corrugation 25. Similarly, the lower annulus 33 defines a lower outer shoulder 36, with the outer face 30 of the segmented sidewall section 24 below the annular corrugation 25, and a lower inner shoulder 37, with the outer face 31 of the annular corrugation 25. The upper and lower outer and inner shoulders 34-37 are living hinges which allow the annular corrugation to bend and flex with respect to the longitudinal axis Z.

The outer face 31 of the annular corrugation 25 is set in radially from the outer face 30 by a distance D, such that the "depth" of the annular corrugation is the distance D, which will be referred to herein as the depth D. The sidewall 12 of the straw has a thickness E. The distance D and depth E are shown most clearly in FIG. 5 on another annular corrugation 25. The depth D of the annular corrugation 25 is approximately two and two-thirds times greater than the thickness of the sidewall 12. When the straw 10 is straight, as shown in FIG. 4, the outer face 31 of the annular corrugation 25 has a height F between the upper inner shoulder 35 and the lower inner shoulder 37 which is one and a half times greater than the depth D of the annular corrugation 25.

To effect a bend in the straw 10, at least one of the annular corrugations 25 must deform flexibly at an angle to the longitudinal axis Z. Angular deformation of the annular corrugation 25 occurs when the upper and lower annuli 32 and 33 compress toward each other and the upper outer shoulder 34 and lower outer shoulder 35 are brought toward each other, or preferably into contact with each other, on one side of the annular corrugation 25 only, such that the upper and lower outer shoulders 34 and 35 continue to be spaced apart from each other on the opposed side. As seen in FIG. 5, the living hinges of the upper and lower outer and inner shoulders 34-37 are bent and allow the upper and lower outer shoulders 34 and 36 to come together and the upper and lower inner shoulders 35 and 37 to splay apart from each other so as to affect the bend in an accordion fashion. The upper and lower annuli 32 and 33 collapse into the interior 20 of the straw 10. When the annular corrugation 25 is angularly deformed in this way, the segmented sidewall sections 24 above and below the annular corrugation 25 are angularly offset with respect to each other and are slightly transverse. When several or all of the annular corrugations 25 are angularly deformed in this way, several or all of the segmented sidewall sections 24 are angularly offset with respect to each other and are slightly transverse, effecting a substantial bend in the straw 10, as shown in FIGS. 2 and 5. The bend may be formed by a user without damaging the segmented sidewall sections 24 or the sidewall 12 of the straw 10, so that the straw 10 can be resiliently returned to its original shape merely by bending back straight along the longitudinal axis Z, so as to bring the straw 10 into its original and straight alignment. When this occurs, the annular corrugations 25 return to their original shape and are aligned coaxially with the segmented sidewall sections 24. The straw 10 thus has the material characteristics of shape memory, strength, and resiliency.

The tip 23 of the straw 10 has a length G that, when the straw 10 is straightened, is approximately ten times greater than the height F of the outer face 31 of the annular corrugation 25 and is approximately twice as long as the height C of one of the segmented sidewall sections 24.

Construction of the straw 10 takes place on several machines. The cylindrical body 11 of the straw 10 is formed by spirally winding the plies of paper material into tubes, and those tubes are then cut and fed to a corrugating machine to impress the annular corrugations 25 into the tube so as to form the straw 10 for distribution. Throughout the rest of this description, the term "tube" or "tubes" will be used to refer to the paper cylinders which are being fed into the corrugating machine and have not been impressed with annular corrugations, and the term "straw 10" or "straws 10" will refer to tubes which have at least one corrugation, as will be made clear herein. The process and machine for spirally winding the plies of paper material into tubes, and for cutting the tubes to length, forms no part of this invention.

Figure 6:
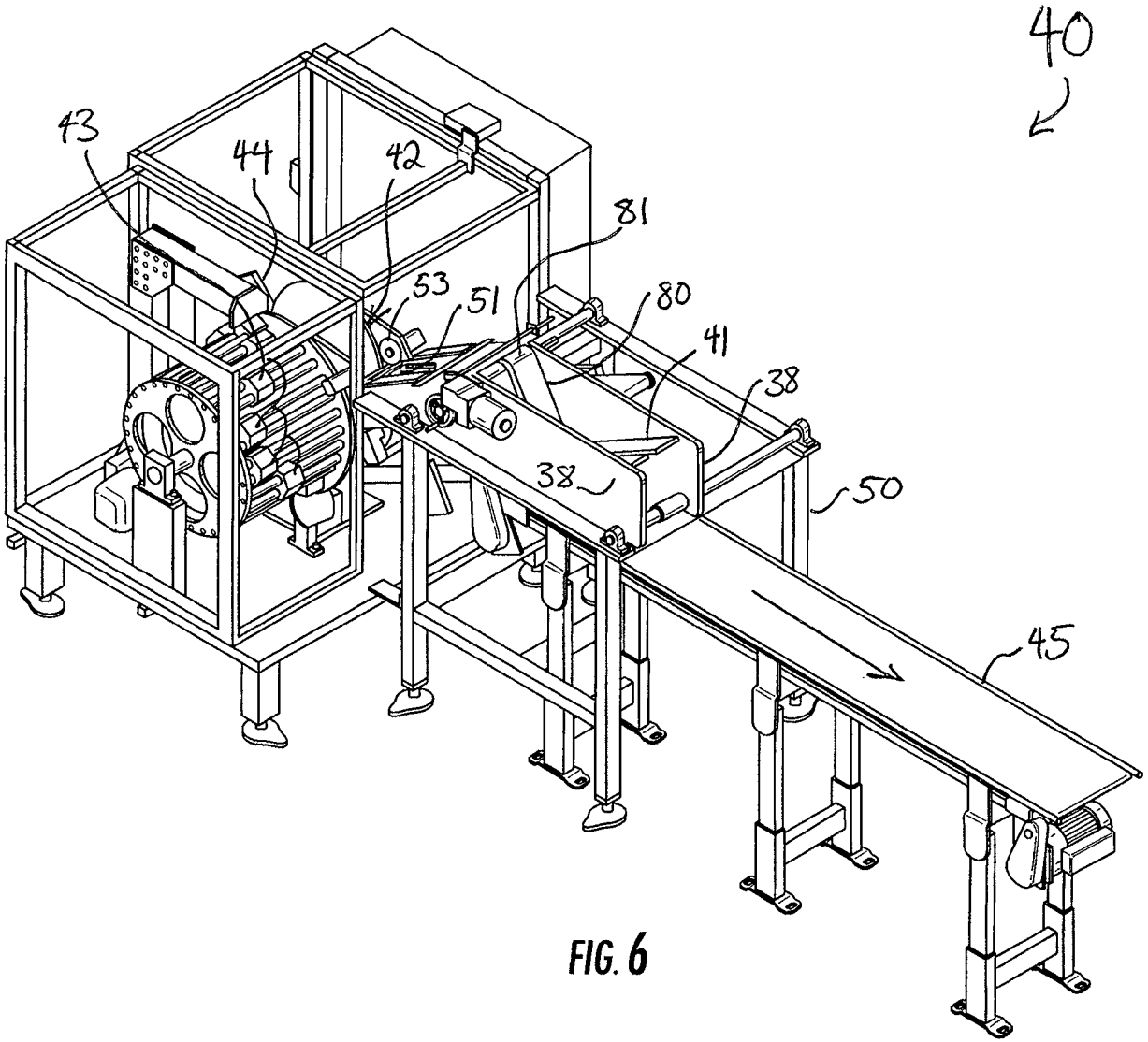
FIGS. 6 and 7 are top perspective views of a corrugating machine constructed and arranged according to the principle of the invention.

The corrugating machine is shown in FIGS. 6-15 and is identified with the reference character 40. Referring first to FIG. 6, the corrugating machine 40 includes a feed track 41 for feeding tubes into a rotating assembly spool 42, and a plurality of forming mandrels 43 which pick up and carry the tubes and engage with a blade armature 44 encircling the rear of the assembly spool 42 to impress the annular corrugations 25 into the tubes so as to form them into straws 10 and then deposit the straws 10 onto a downstream off-feed ramp 45. The corrugating machine 40 is uniquely constructed to rapidly form the annular corrugations in tubes at very high speeds without damaging or tearing the paper from which the tubes are constructed.

Referring to FIGS. 6-9, the corrugating machine 40 is mounted to a framework 50 which includes a table and structural frame members. The feed track 41 is mounted above the table and upstream from the assembly spool 42. Opposed walls 38 are disposed on either side of the feed track 41 and are spaced by the length of a tube 51. The tubes 51 are fed onto the feed track 41 from a hopper (not shown and not forming a part of this invention), and the walls 38 of the feed track 41 prevent lateral movement of the tubes 51 on the feed track 41. The feed track 41 is generally Z-shaped, having an upstream descending portion, a downstream ascending portion, and a downstream descending portion which descends toward the assembly spool 42 so as to load the tubes 51 to the assembly spool 42. The tubes 51 are loaded onto the feed track 41 and moved downstream into the assembly spool 42 by advancing a belt 80 or a pusher cam in the feed track 41. A plurality of tubes 51 can be seen in FIGS. 6 and 7 at the downstream end of the feed track 41 aligned and ready to be loaded into the assembly spool 42.

Once the tubes have moved over a crest 81 in the feed track 41 just before the downstream descending portion of the feed track 41, the tubes 51 collect in series, one behind the other, stacking in a line of tubes 51 waiting to be loaded into the assembly 42 to be engaged and formed into straws 10. A pair of opposed brushes 53, seen best in FIG. 11 (which is an enlarged top perspective view of the corrugating machine 40), lightly press downward on the tubes 51 into the feed track 41 so as to apply positive pressure to the tubes 51 so that the tubes 51 do not buckle, roll, move, bunch, gather, or otherwise come out of alignment with the assembly spool 42. The tubes 51 are held ready to be applied onto the forming mandrels 43 about to extend toward the assembly spool 42. The brushes 53 are rotating hubs fitted with radially-projecting bristles and are mounted on drive shafts for rotation by motors 52 mounted proximate to the assembly spool 42. Rotating the brushes 53 controls the rate at which the tubes 51 are individually loaded from the feed track 41 into the assembly spool 42; this rotational speed is controlled in concert with the operation of the assembly spool 42 and the forming mandrels 43 to coordinate loading of the tubes 51 from the feed track 41 into the assembly spool 42.

Figure 12:
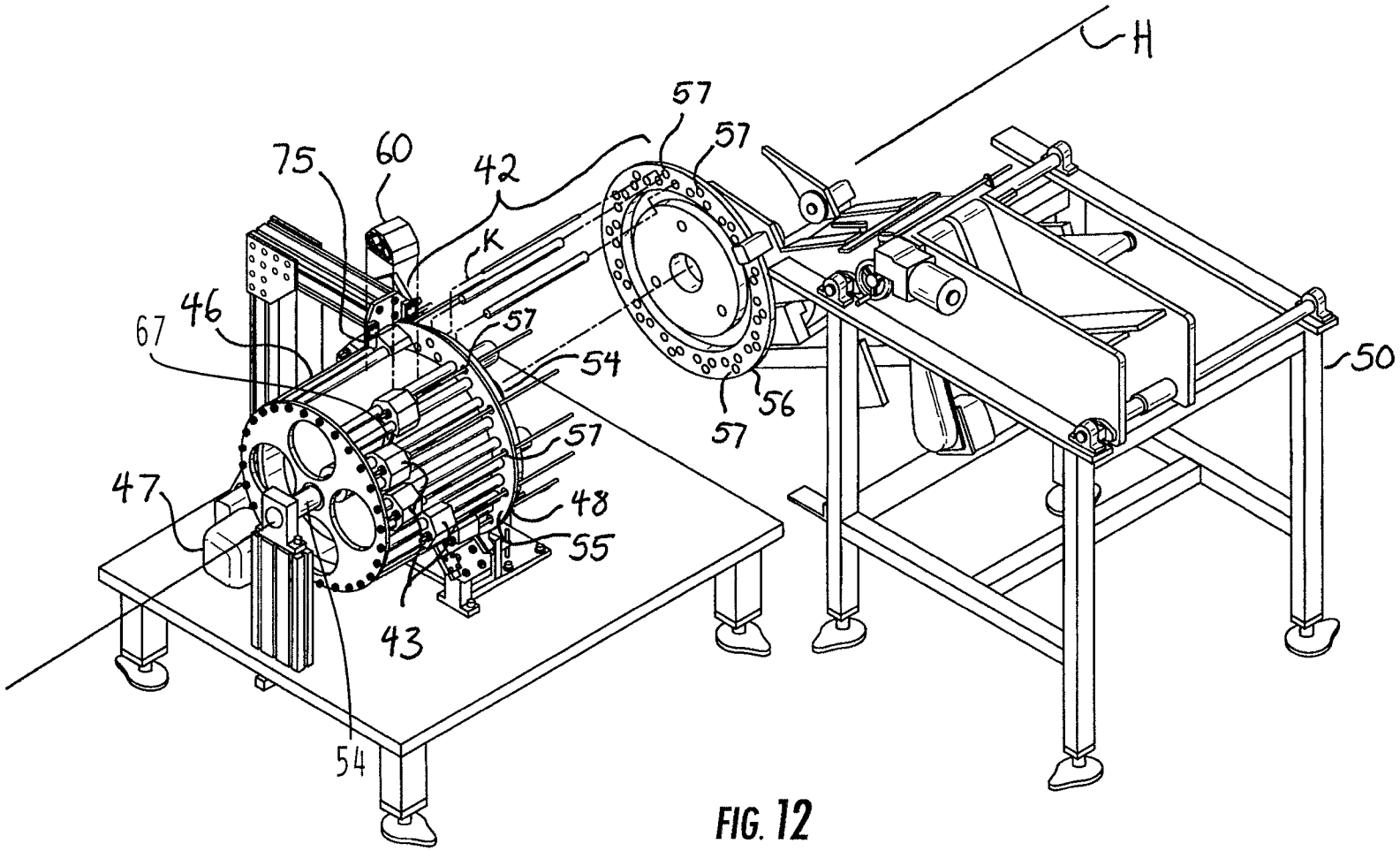
FIGS. 12 and 13 are exploded and assembled views of the assembly spool, drum, and forming mandrels of the corrugating machine of FIG. 6.
Figure 13:
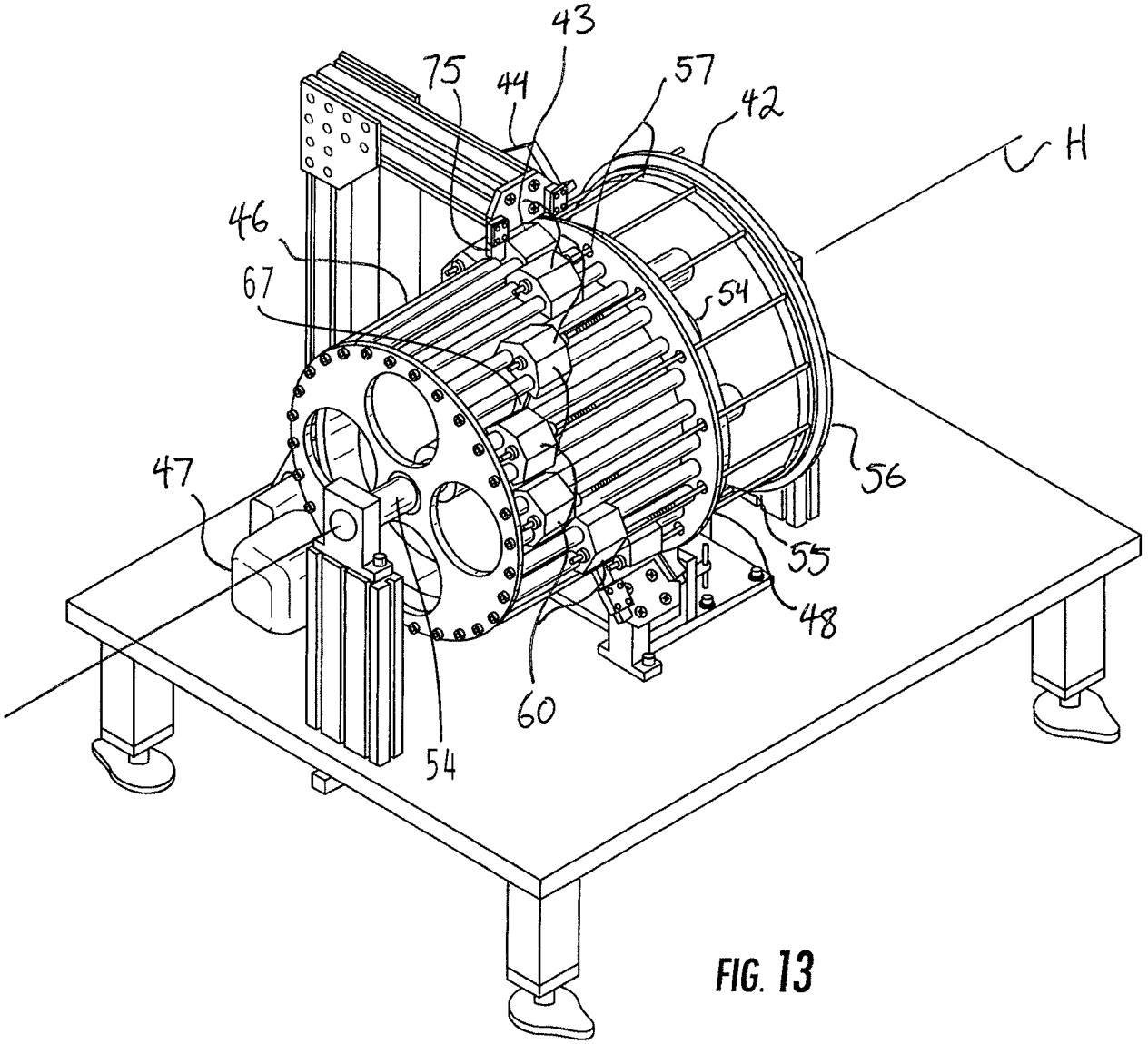

As shown in FIGS. 12 and 13, the assembly spool 42 is a spool-shaped structure mounted for rotation to the framework 50 of the corrugating machine 40 about a common axis H. The assembly spool 42 is structured to capture the tubes 51 on the forming mandrels 43 for rotation to hold the tubes 51 and prevent lateral movement of the tubes 51, during which movement the tubes 51 are rolled against the blade armature 44 to interpose the tubes 51 between the forming mandrels 43 and the blade armature 44 to form the annular corrugations 25 in the tubes 51. The assembly spool 42 includes a central axle 54 and two opposed circular walls or plates 55 and 56. The plates 55 and 56 each have outer circumferences corresponding to a diameter of the assembly spool 42, and the outer edges of the plates 55 and 56 are formed with a plurality of holes 57 for receiving, aligning, and holding the forming mandrels 43 applied with the tubes 51.

Still referring to FIGS. 12 and 13, the holes 57 are aligned with the forming mandrels 43 opposite the plate 56. The forming mandrels 43 are carried on a drum 46 mounted coaxially to a side of the assembly spool 42. The drum 46 is rigidly fixed to and rotates together with the assembly spool 42 about the common axis H of the assembly spool 42. The forming mandrels 43 are mounted for reciprocation on the drum 46 to slide into and out of the assembly spool 42 in a direction parallel to the common axis H. The drum 46, being fixed to the assembly spool 42 proximate to the plate 55, rotates together with the assembly spool 42 so that each of the forming mandrels 43 remains aligned with the holes 57 formed in the plates 55 and 56. A motor 47 is coupled to the drum 46 proximate to the assembly spool 42 with a frictional drive belt 48. The motor 47 imparts rotation to both the assembly spool 42 and the drum 46. The motor 47 and drive belt 48 are most clearly illustrated in the side elevation of FIG. 9 and the rear elevation of FIG. 10. The drive belt 48 frictionally engages the circumference of the plate 55 to rotate the assembly spool 42 and the drum 46.

Figure 11:
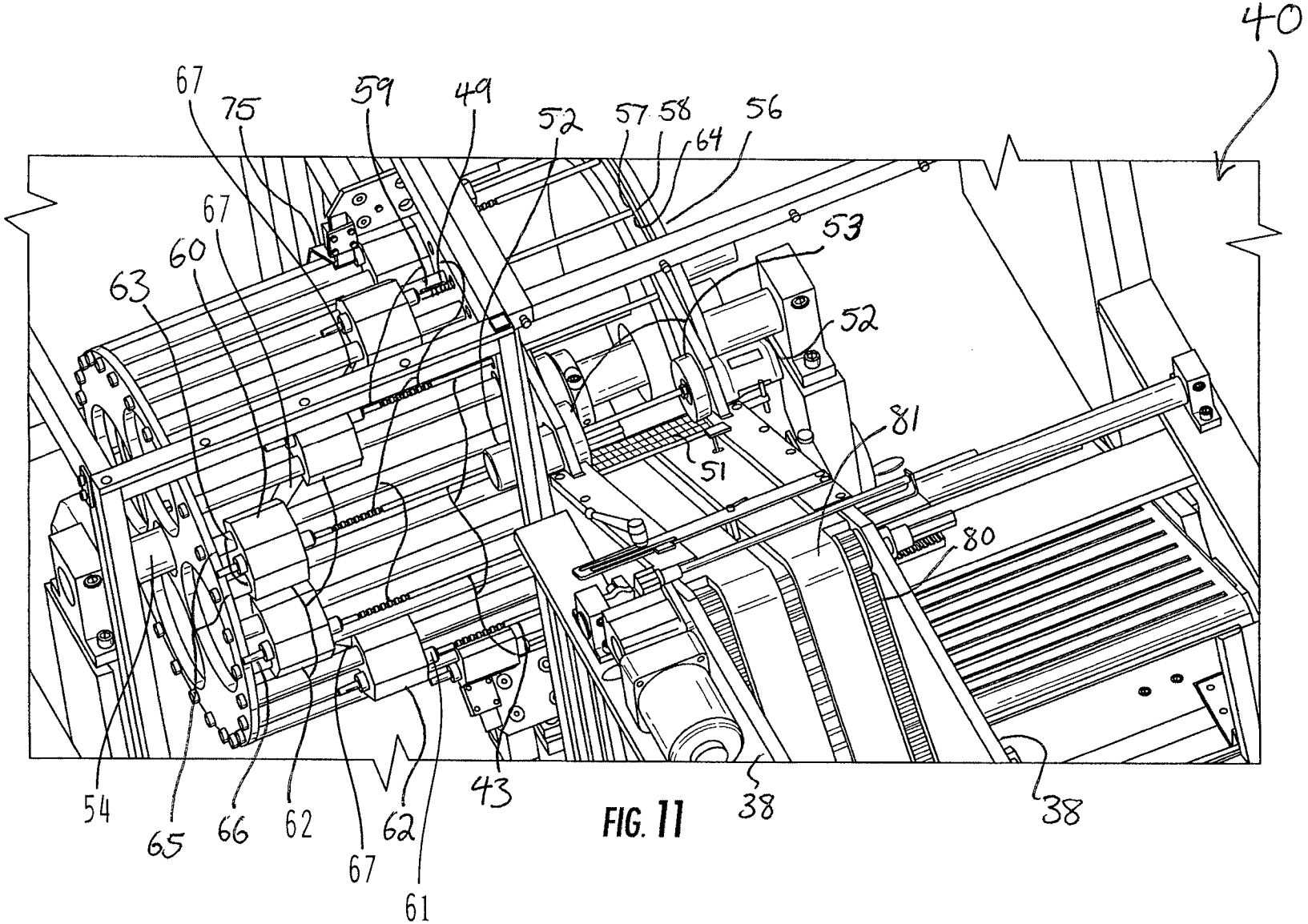
FIG. 11 is an enlarged top perspective view of the corrugating machine of FIG. 6, showing an assembly spool, a drum, and forming mandrels carried on the drum.

Referring now to FIG. 11, the forming mandrels 43 are illustrated, and it can be seen that each forming mandrel 43 is carried in a mandrel assembly 62. Each forming mandrel 43 is a long, cylindrical spindle having a tip 58 and an opposed base 59 seated in the mandrel assembly 62. Between the tip 58 and the base 59 are a plurality of annular channels 49, each extending continuously around the forming mandrel 43. There are preferably nine channels 47, each of which corresponds to the preferably nine annular corrugations 25 formed in the straw 10. The channels 47 are sized and shaped to form those annular corrugations 25 when a tube 51 is carried on the forming mandrel 43 and is rolled against the blade armature 44. The forming mandrel 43 is held in the mandrel assembly 62, which includes a housing 60, a chuck 61, and two cylindrical guides 63. The chuck 61 is tightened to the base 59 of the forming mandrel 43 to secure the forming mandrel 43 in the mandrel assembly 62. The chuck 61 is mounted for free rotation within a drum in the housing. Briefly, the chuck 61 rotates in response to rotational movement of the forming mandrel 43 with respect to the drum 46. As will be explained, the forming mandrels 43 rotate within the mandrel assembly 62 as the corrugating machine 40 is operated.

The mandrel assemblies 62 are mounted on a pair of rails 65 extending across the outer cylindrical face of the drum 46. The cylindrical guides 63 are mounted on the rails 65 for smooth gliding, so that the mandrel assembly 62 reciprocates across the outer cylindrical face of the drum 46 between a retracted position, in which the forming mandrel 43 is retracted away from the plate 56 and out of the assembly spool 42, and an extended position, in which the forming mandrel 43 is advanced out over the assembly spool 42 and through the holes 57 in both of the plates 55 and 56. In the extended position, the forming mandrel 43 is received in the holes 57 in the plate 56. In the plate 56, each of the holes 57 is fitted with a bushing or push-out bearing 64 that ensures proper radial alignment of the forming mandrel 43 in the hole 57. Misalignment of the forming mandrel 43 within the hole 57 is not desired and will physical toggle a switch on the corrugation machine 40 which aborts operation of the corrugating machine 40 and issues an alarm to the operator in response.

During operation of the corrugating machine 40, the mandrel assemblies 62 are initially arranged in the retracted position thereof, away from the assembly spool 42. The drum 46 and the assembly spool 42 rotate synchronously, and as one of the mandrel assemblies 62 approaches approximately the one o'clock position (when viewed from the plate 55), that mandrel assembly 62 begins to move forward toward the extended position, advanced by a cam guide 67 mounted between the bottom of the housing 60 and the drum 46. A single tube 51 is admitted into the assembly spool 42 by the brushes 53, and as, the mandrel assembly 62 moves forward and the drum 46 rotates in a counter-clockwise fashion, the tip 55 of the forming mandrel 43 enters the tube 51. The forming mandrel 43 slides into the tube 51 and picks the tube 51 up off the feed track 41, rotating the tube 51 about the assembly spool 42. The tube 51 is prevented from moving laterally on the forming mandrel 43 by the opposed plates 55 and 56 of the assembly spool 42, and the forming mandrel 43 slides fully into the tube 51 quickly to support the tube 51 axially. Though described as a series of sequential steps, the tube 51 is applied to the advancing forming mandrel 42 in a very quick, fluid, single movement. The tube 51 is then carried around the assembly spool 42, as the assembly spool 42 rotates, for engagement with the blade armature 44.

Figure 7:
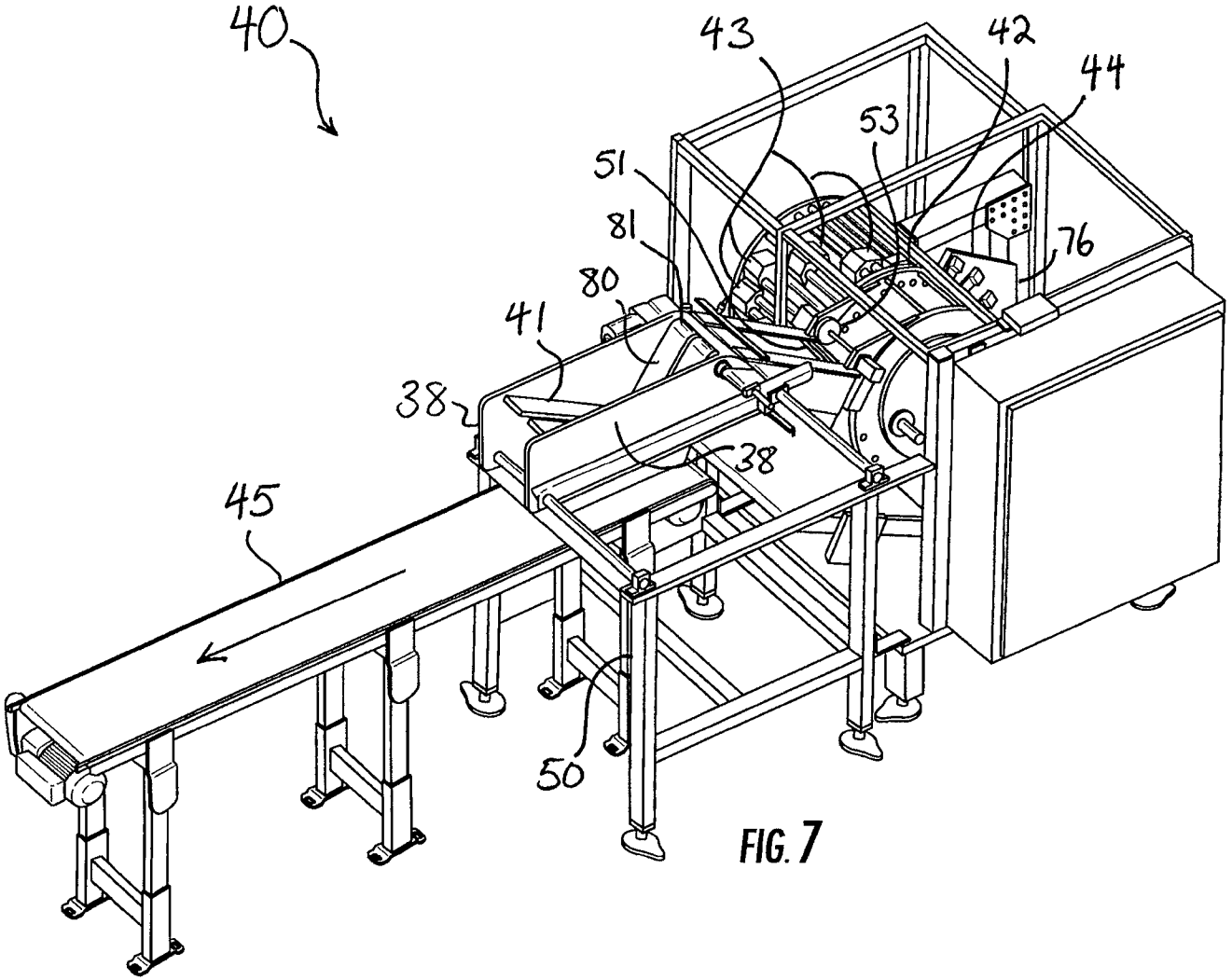
Figure 8:
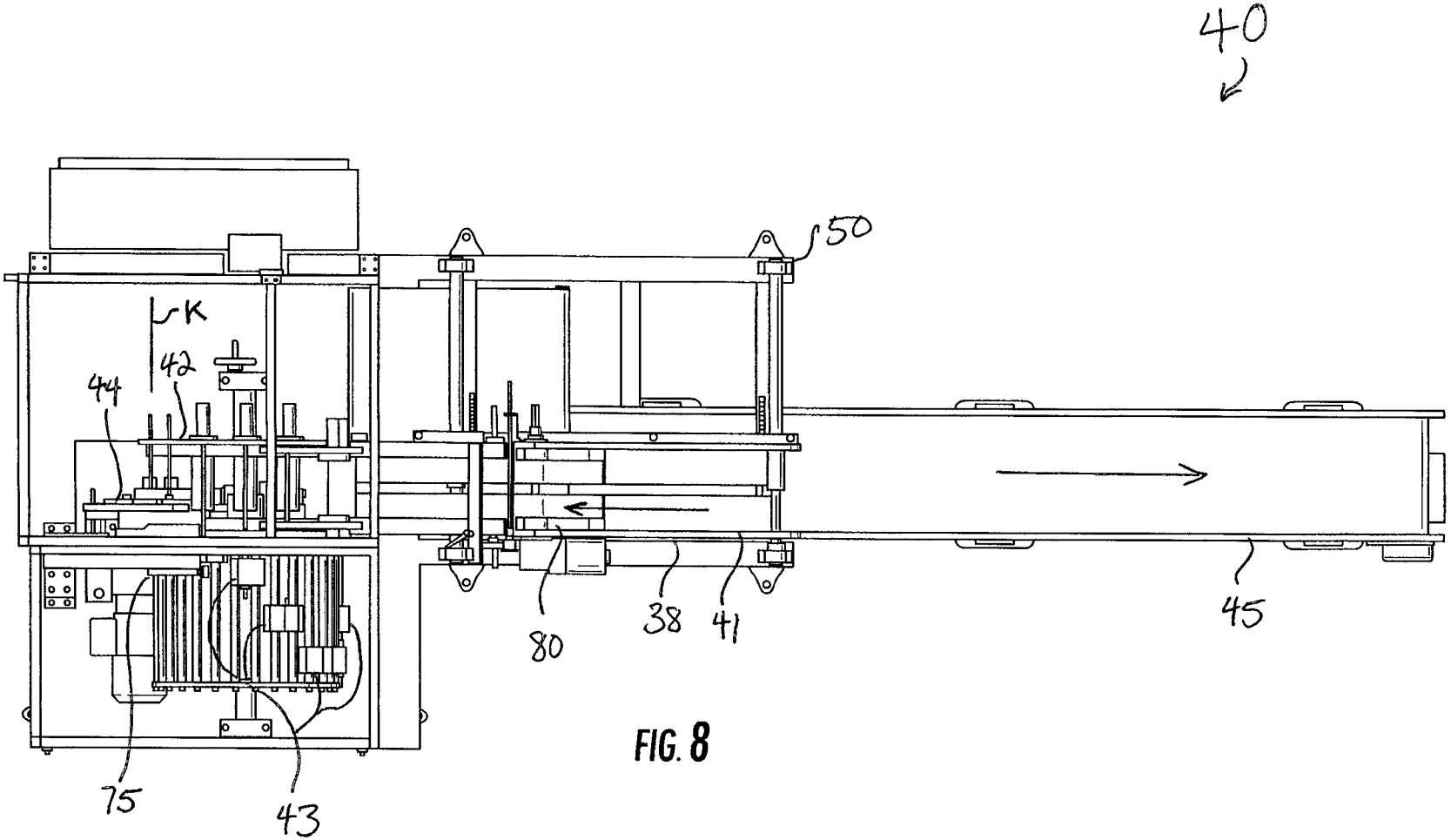
FIGS. 8, 9, and 10 are top plan, side elevation, and rear elevation views, respectively, of the corrugating machine of FIG. 6.
Figure 9:
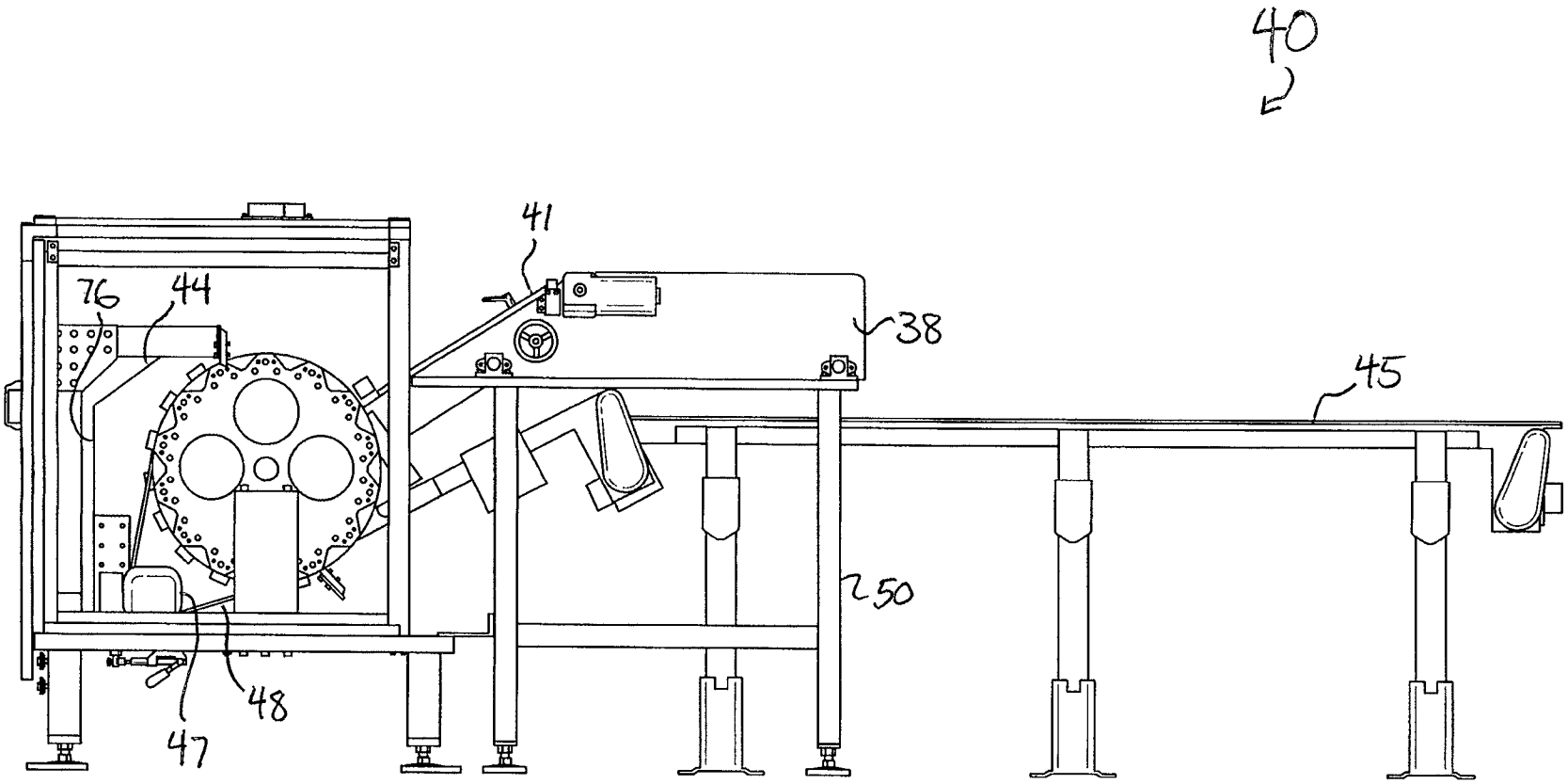
Figure 10:
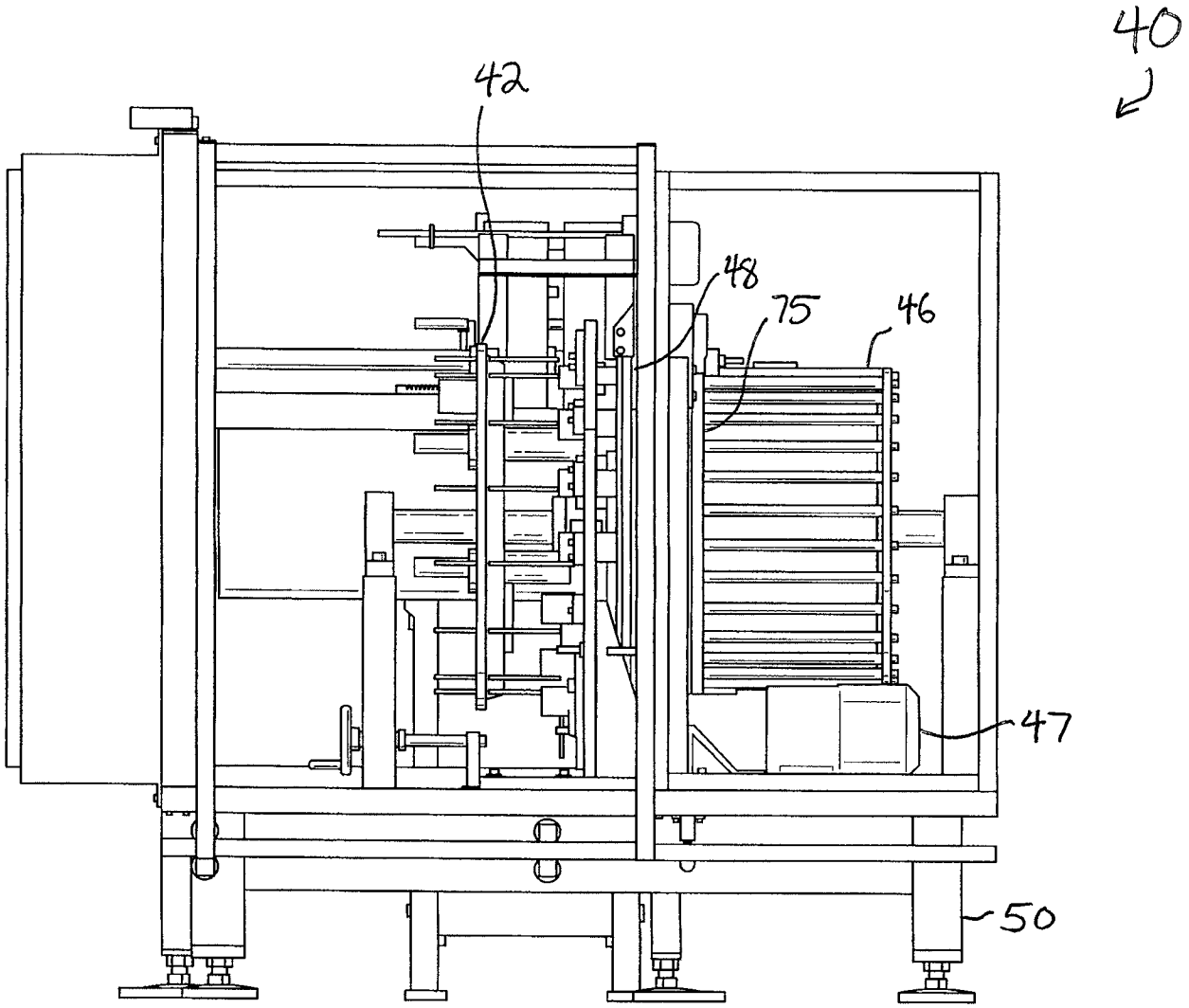
Figure 14:
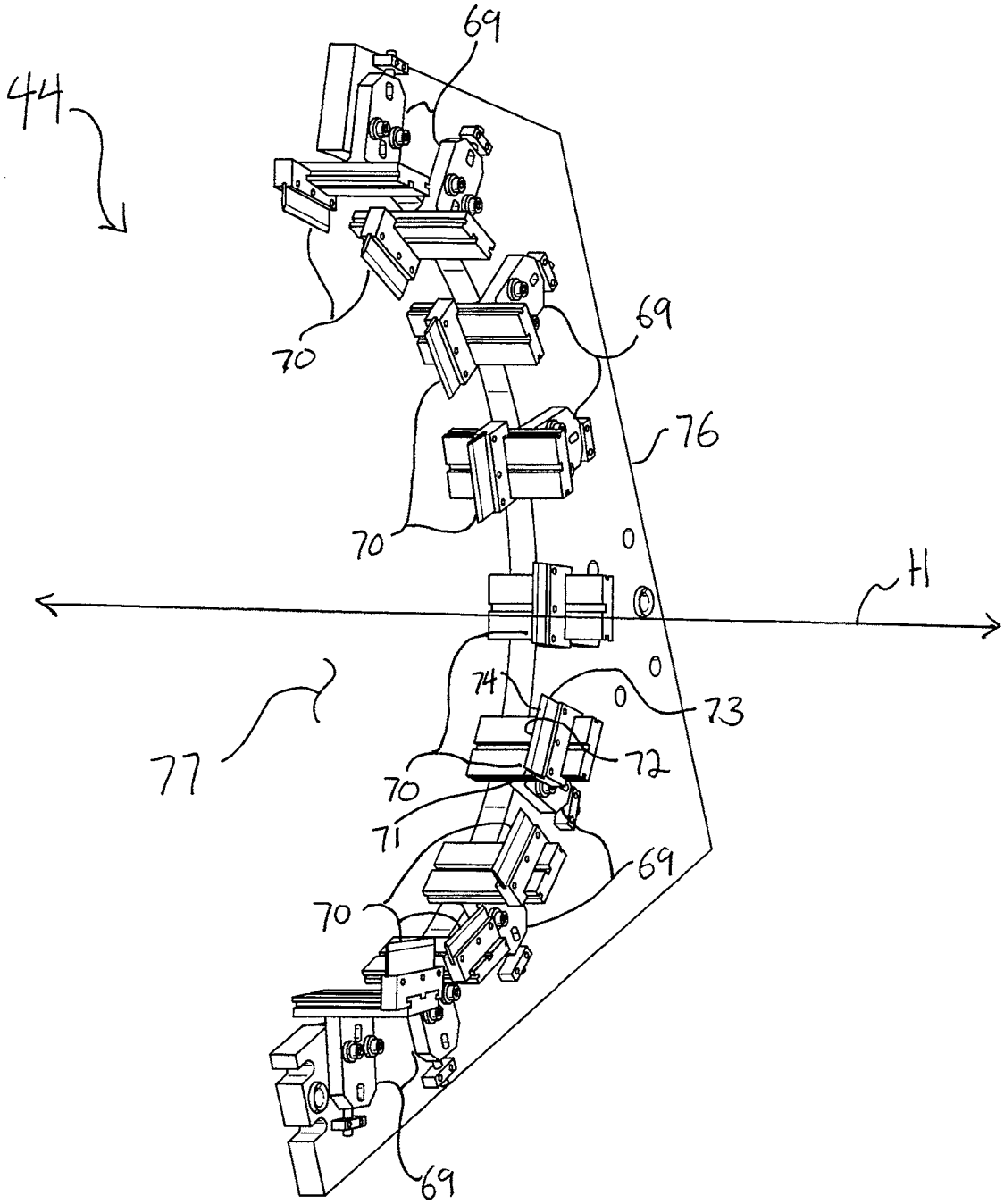
FIGS. 14 and 15 are perspective and side elevation views, respectively, of a blade armature used in the corrugating machine of FIG. 6.
Figure 15:
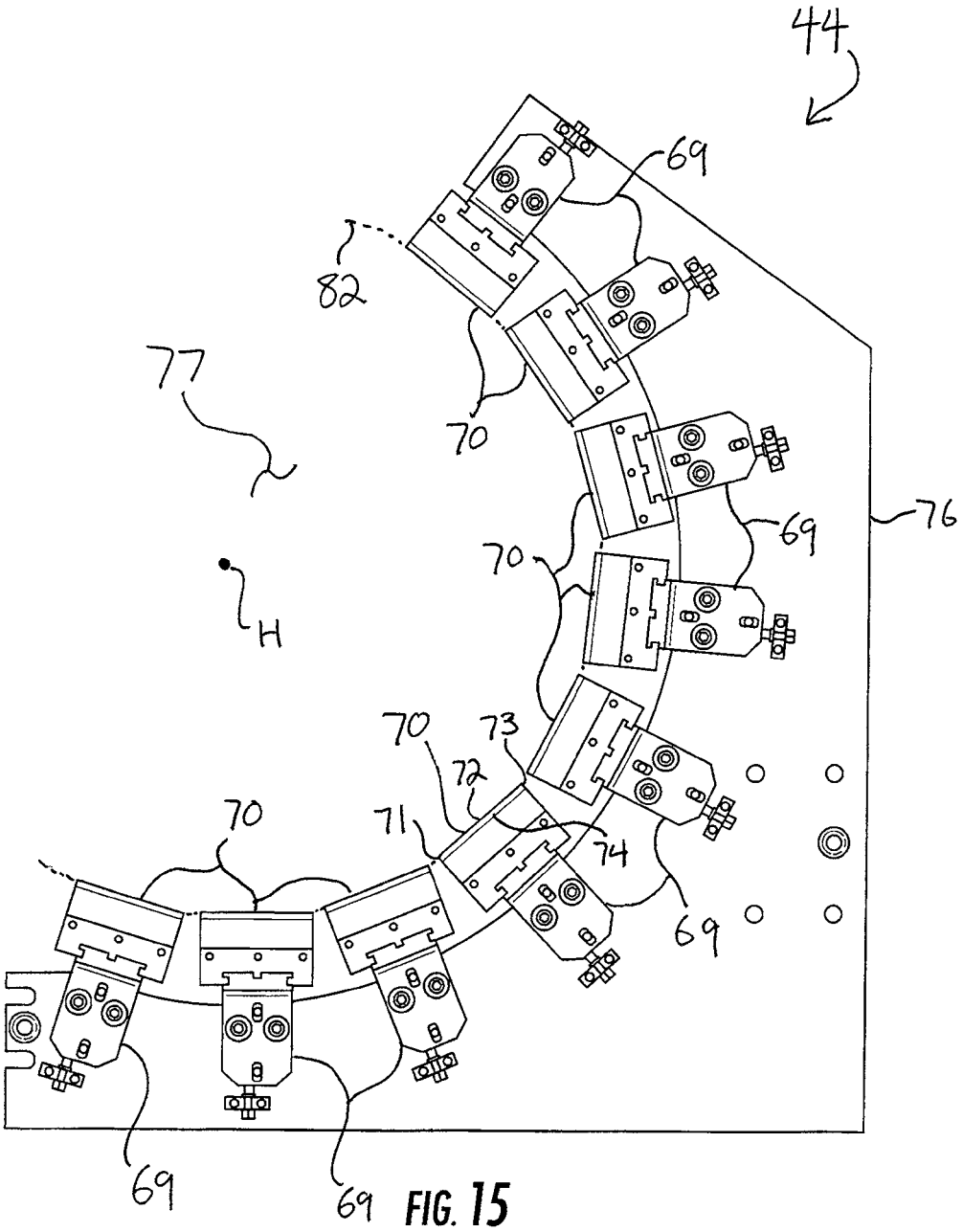

The blade armature 44 is disposed around the assembly spool 42 between the plates 55 and 56 of the assembly spool 42. Referring to FIGS. 14 and 15, the blade armature 44 holds a plurality of corrugating elements, or blades 70, for forming and impressing the annular corrugations 25 into the tubes 51. The blade armature 44 is formed of a convex, structural rib 76 defining an open receiving space 77. Referring briefly to FIGS. 7 and 9, the rib 76 is disposed over the assembly spool 42 so that the assembly spool 42 is within the receiving space 77 and so the rotating tubes 51 engage with the blade armature 44. The rib 76 is spaced apart from the assembly spool 42 by a specific distance, and has an inner curvature which positions each of the blades 70 the same radial distance from common axis H (seen in FIG. 14 as a double-arrowed line and in FIG. 15 as a single point indicating that the common axis H extends into and out of the page).

Nine blades 70, each held in mounts, are preferably secured in laterally-adjustable vises 69 fixed to the rib 76 of the blade armature 44, each blade for forming one of the annular corrugations 25 in the straw 10. The blades 70 are mounted in the vises 69 on the blade armature 44 along an arc 82 formed cooperatively across the edges of the blades 70. The arc 82 is represented in FIG. 15 with a broken line extending around and between the blades 70. The blades 70 are adjusted and secured in position so that the arc 82 formed by the blades 70 is defined about the common axis H. That is, each blade 70 is radially equidistant from the common axis H and oriented tangentially with respect to the common axis H and the arc 82 formed cooperatively by the blades 70.

The following description of the blades 70 will refer to only one of the blades 70 shown in FIG. 15, and it will be understood that the construction of all of the blades 70 is identical to the herein-described blade 70, and that the blades 70 are different only in mounting, position, and arrangement, as will be described as well. The blade 70 has a first end or entrance 71, a middle 72, and a second end or exit 73 of an edge 74 of the blade 70. The edge 74 of the blade 70 is arcuate from the entrance 71 through the middle 72 to the end 73, and generally corresponds to the arc 82 formed cooperatively across the edges 74 of all of the blades 70 and the distance the blade 70 is radially from the common axis H. The edge 71 of each blade 70 is slightly ramped, so that the entrance 71 is slightly further radially away from the common axis H than the middle 71, which is in turn also slightly further radially away from the common axis H of the assembly spool 42 than the exit 72 is. Additionally, each blade 70 has a slight lead-in angle at the entrance 71 to prevent intrusion of the blade 70 into the paper of the sidewall 12 of the tube 51, and to allow for initial, gentle depression and formation of the annular corrugation 25. The edge 74 is blunt and not sharp so that the edge 74 of the blade 70 does not tear into or puncture the paper of the sidewall 12. In this arrangement, as the tube 51 is rolled against the blade 70, the annular corrugation 25 is made progressively deeper by the ramped edge 74.

To form the annular corrugations 25 in one of the tubes 51, the tubes 51 are "over-rolled" on the forming mandrels 43 against the blades 70. Over-rolling is the process of rolling the tube 51 multiple times over the same blade 70. As each mandrel assembly 62 moves forward into the extended position thereof, the mandrel extension 66 in the mandrel assembly 62 comes in contact with and frictionally engages a stationary belt 75, as seen in FIGS. 8 and 10-13. The belt 75 is fixed and held stationary, but the mandrel assembly 62 moves against the belt 75 as it rotates with the drum about the common axis H, so that the relative movement between the belt 75 and the mandrel assembly 62 causes the mandrel extension 66 to rotate clockwise as it engages the belt 75. The mandrel extension 66 is rigidly coupled to the chuck 61 to impart rotational movement to the chuck 61 holding the forming mandrel 43; the chuck 61 is freely rotatable within the housing 60 so that as the mandrel extension 66 rolls along the belt 75, the mandrel extension 66 rotates, the chuck 60 rotates, and the forming mandrel 43 carried in the chuck 60 thereby rotates as well. Thus, the forming mandrel 43 rotates clockwise, holding the tube 51 thereon, as the mandrel assembly 62 moves counter-clockwise around the common axis H. In other words, the forming mandrel 43 has two rotational movements: one about the common axis H caused by being carried on the drum 46, and another about an axis K that extends through the forming mandrel 43 itself, caused by interaction of the mandrel assembly 62 with the belt 75. As the forming mandrel 43 moves over each blade 70, the forming mandrel 43 is rotated three full rotations by the belt 75, so that the tube 51 is rolled three times to form each annular corrugation 25. The edge 74 of each blade 70 presses the paper sidewall 12 of the tube 51 inward into the channels 57 in the forming mandrel 43, such that the annular corrugations 25 are formed. This inward pressing of the paper sidewall 12 shortens the length of the tube 15, so that each time the tube 51 is moved against another blade, the tube 15 becomes progressively shorter. Each time an annular corrugation 25 is formed, the tube 51 is shortened by approximately 1/32 inch (approximately 0.079 centimeters). Without over-rolling and a blunt blade 70, the paper sidewall 12 would tear instead of shortening.

The blades 70 are spaced apart in a forward direction transverse to the common axis H. Also, the blades 70 are spaced-apart in a lateral direction parallel to the common axis H. In this way, the blades 70 are offset with respect to each other, and the tubes 51 roll progressively over one blade 70, then a spaced-apart blade 70, then another spaced-apart blade 70, and onward. Were the blades 70 not spaced apart laterally and forwardly, the paper sidewall 12 of the tubes 51 would tear and rip, as paper could not withstand simultaneous formation of all of the annular corrugations 25. Impression of corrugations in the paper of the sidewall 12 at once would shorten and cause the paper to tear. Referring to FIG. 14, the blades 70 are spaced apart in a lateral direction along the common axis H, such that as each tube 51 rolls against each subsequent blade 70, an annular corrugation 25 is formed adjacent to the annular corrugation 25 just formed by the previous blade 70 against which the tube 51 was just rolled. The top-most blade 70 in the blade armature 44 is a "first" or outermost blade 70, in that the top-most blade 70 is closest to the drum 46 and the plate 55 (or furthest to the left as shown in FIG. 14). This blade 70 forms the annular corrugation 25 closest to the top 14 of the straw 10.

The blade 70 just below the top-most blade 70 is spaced slightly laterally apart from the top-most blade 70 (as seen in FIG. 14), slightly closer to the plate 56. This blade 70 is spaced apart from the top-most blade 70 by a distance equal to the height C of the segmented sidewall section 24 between the annular corrugations 25. Similarly, the next highest blade 70 in the blade armature 44 is offset by the same distance. Each subsequent blade 70 in the blade armature 44 is set apart from the previous blade 70 by a distance equal to the distance C between the annular corrugations 25. Thus, the blades 70 are spaced apart in both lateral and forward, or arcuate, directions. These lateral and forward directions are normal to each other. In this way, as a tube 51 is rolled against the blades 70 in the blade armature 44 from the top to the bottom of the blade armature 44, the annular corrugations 25 are formed sequentially in the tube 51, until the straw 10 is produced with nine annular corrugations 25. By "sequentially," it is meant that the annular corrugations 25 are formed by one-by-one, and not contemporaneously or simultaneously.

Referring to FIGS. 6-9, after the tube 51 rolls against the last, or bottom-most, blade 70 and is thus formed into a straw 10, the mandrel assembly 62 moves back to the retracted position thereof, urged into such movement by the cam guide 67 disposed between the housing 60 and the drum 46 moving away from the plate 55. The straw 10 is held in place between the plates 55 and 56 of the assembly spool 42 by the plates 55 and 56 as the forming mandrel 43 moves fully into the retracted position and slips out of the straw 10. Once the forming mandrel 43 has been completely removed from the straw 10, the straw 10 falls onto the off-feed ramp 45, which has a belt that carries the formed straws 10 away from the corrugating machine 40.

The above-described process is performed for many tubes 51, thereby forming many straws 10. The corrugating machine 40 has a high capacity, such that it can hold many tubes 51 at once, and can form straws 10 at high rates of speed. In this way, large quantities of straws 10 emerge from the blade armature 44 and are carried out of the corrugating machine 40 and onto the off-feed ramp 45, ready for packaging and distribution.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof

The invention claimed is:

1. A machine for forming corrugations in a tube having a length and a diameter, the machine comprising:

a corrugation machine including a plurality of corrugating elements, each spaced apart from each other in both a lateral direction and a forward direction, and each radially set apart from a common axis which is offset from a longitudinal axis of the tube;

an assembly spool connected to the corrugation machine by a framework, the assembly spool having an axle coaxial with the common axis, the axle supporting a first plate and a second plate parallel to and spaced apart from the first plate by at least the length of the tube;

a drum mounted to the first plate for synchronous rotation with the assembly spool about the common axis; and a mandrel mounted to the drum for reciprocation into and out of the assembly spool parallel to the common axis, the mandrel configured to carry the tube.

2. The machine of claim 1, wherein the tube is comprised of paper.

3. The machine of claim 2, wherein the first plate includes an opening sized to receive the mandrel as the mandrel reciprocates into and out of the assembly spool.

4. The machine of claim 3, wherein the opening sized to receive the mandrel has a diameter that is smaller than the diameter of the tube.

5. The machine of claim 4, further comprising a feed track for receiving a series of tubes, the feed track having a first track end, a second track end, and a length extending between the first track end and the second track end, the second track end positioned proximate to the assembly spool.

6. The machine of claim 5, wherein the feed track includes a first wall extending at least partially along the length of the feed track and a second wall extending at least partially along the length of the feed track opposite, at least in part, the first wall and spaced apart from the first wall by at least the length of the tube.

7. The machine of claim 6, further comprising a hub having bristles, the bristles configured for contacting a surface of at least one tube of the series of tubes received by the feed track, such that the contact between the bristles and the tube surface advances the series of tubes along the feed track.

8. The machine of claim 7, wherein the feed track includes an ascending portion having an upper end and a lower end, an upstream descending portion, and a downstream descending portion, the ascending portion adjacent to the upstream descending portion at the lower end, the ascending portion and the upstream descending portion angled to form a valley at the lower end, and to the downstream descending portion at the upper end, the ascending portion and the downstream descending portion angled to form a crest at the upper end.

9. The machine of claim 4, wherein the mandrel is formed in a generally cylindrical shape having a plurality of annular channels formed in the mandrel, the annular channels spaced longitudinally apart along at least a portion of the mandrel.

10. The machine of claim 9, wherein the mandrel includes a tip formed on a longitudinal end of the mandrel and a base formed on an opposing side of the plurality of annular channels from the tip, the base mounted to the drum by means of a mandrel assembly that allows free axial rotation of the mandrel with respect to the drum.

11. The machine of claim 10, wherein the drum further includes one or more rails extending across an outer face of the drum, and wherein the mandrel assembly includes a housing, the housing connecting one or more cylindrical guides to a chuck, the one or more cylindrical guides slidably mounted to at least one of the rails in a manner that allows the mandrel assembly to reciprocate, guided by a cam guide positioned between the housing and the drum, the chuck connected to the housing in a manner that allows the chuck to rotate, and the chuck securing the mandrel, such that the axial rotation of the mandrel rotates the chuck.

12. The machine of claim 11 wherein the corrugating elements are blunt elements.

13. A method of forming corrugations in a tube having a length, a diameter, a circumference, and a longitudinal axis, the method comprising:

loading the tube onto a feed track of a machine;

inserting a mandrel having a mandrel longitudinal axis and an annular channel spaced along the mandrel longitudinal axis into the tube;

rotating the mandrel and the tube about the mandrel longitudinal axis;

moving the axially rotating mandrel and the tube into a position such that the annular channel aligns with a corrugating element on opposing sides of the tube;

moving the axially rotating mandrel and the tube against the corrugating element to form a corrugation in the tube corresponding to the aligned annular channel; and moving the axially rotating mandrel and the tube against another corrugating element aligned with another annular channel to form another corrugation in the tube.

14. The method of claim 13, wherein the rotating of the mandrel and tube about the mandrel longitudinal axis includes the steps of moving a portion of the mandrel into contact with a surface and moving the mandrel along the surface, the contact between the mandrel and the surface as the mandrel moves along the surface generating frictional rotation of the mandrel.

15. The method of claim 14, further comprising the step of advancing a series of tubes along an upstream descending portion of the feed track, advancing the series of tubes along an ascending portion of the feed track, and advancing the series of tubes over a crest and then along a downstream descending portion of the feed track.

16. The method of claim 15, further comprising the step of rotating a hub having bristles against a plurality of the series of tubes on the feed track, the contact between the bristles and the plurality of tubes advancing the plurality of tubes along the feed track and aligning the plurality of tubes for sequential insertion of the mandrel.

17. A method of forming corrugations in a tube having a length, a diameter, a circumference, and a longitudinal axis, the method comprising:

loading the tube onto a feed track of a machine, the machine having an assembly spool and an adjacent drum that share a common axis;

inserting a mandrel having a mandrel longitudinal axis and an annular channel spaced along the mandrel longitudinal axis into the tube, including sliding the mandrel parallel to the common axis from a starting position at least in part within the drum into an advanced position at least in part within the assembly spool and through the tube;

rotating the mandrel and the tube about the mandrel longitudinal axis, including moving a portion of the mandrel into contact with a surface and moving the mandrel along the surface, the contact between the mandrel and the surface as the mandrel moves along the surface generating frictional rotation of the mandrel;

moving the axially rotating mandrel and the tube into a position such that the annular channel aligns with a corrugating element on opposing sides of the tube;

moving the axially rotating mandrel and the tube against the corrugating element to form a corrugation in the tube corresponding to the aligned annular channel; and moving the axially rotating mandrel and the tube against another corrugating element aligned with another annular channel to form another corrugation in the tube.

18. The method of claim 17, wherein the step of sliding the mandrel includes guiding the mandrel with a cam guide.

19. The method of claim 18, wherein the step of moving the axially rotating mandrel and the tube against the corrugating element includes coincidentally rotating the axially rotating mandrel and the tube about the common axis.

20. The method of claim 19, wherein the step of rotating the axially rotating mandrel and the tube about the common axis further includes synchronously rotating the drum and the assembly spool about the common axis.

21. There method of claim 20, wherein the step of moving the axially rotating mandrel and the tube against the corrugating element includes moving the tube against the corrugating element for a distance greater than the circumference of the tube.

22. The method of claim 21, further comprising the step of retracting the mandrel out of the assembly spool and out of the tube, releasing the tube.

* * * * *